US005935899A

United States Patent [19]

Suzaki et al.

[11] Patent Number: 5,935,899

[45] **Date of Patent: *Aug. 10, 1999**

[54] THERMOSENSITIVE RECORDING MATERIAL

[75] Inventors: Hideo Suzaki, Numazu; Hideo Aihara, Fuji, both of Japan

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/717,238

[22] Filed: Sep. 20, 1996

[30] Foreign Application Priority Data

| | | | |
|---|---|---|---|
| Sep. 21, 1995 | [JP] | Japan | 7-266189 |
| Aug. 12, 1996 | [JP] | Japan | 8-227382 |

[51] Int. Cl.[6] ..... B41M 5/40

[52] U.S. Cl. ..... 503/207; 427/152; 503/200; 503/226

[58] Field of Search ..... 427/152; 503/200, 503/207, 226

[56] References Cited

U.S. PATENT DOCUMENTS

| | | | |
|---|---|---|---|
| 5,229,349 | 7/1993 | Kurisu et al. | 503/200 |
| 5,447,900 | 9/1995 | Suzaki et al. | 503/207 |
| 5,482,911 | 1/1996 | Hiroishi et al. | 503/200 |
| 5,482,912 | 1/1996 | Furuya et al. | 503/207 |

FOREIGN PATENT DOCUMENTS

| | | | |
|---|---|---|---|
| 61-69489 | 4/1986 | Japan | 503/207 |
| 62-173284 | 7/1987 | Japan | 503/207 |
| 1-133783 | 5/1989 | Japan | 503/207 |
| 4-232091 | 8/1992 | Japan | 503/207 |

*Primary Examiner*—Bruce H. Hess

*Attorney, Agent, or Firm*—Oblon, Spivak, McClelland, Maier & Neustadt, P.C.

[57] ABSTRACT

A thermosensitive recording material comprises a thermosensitive recording layer comprising a binder resin, and a leuco dye and a color developer capable of inducing color formation in the leuco dye upon application of heat thereto, and a protective layer on the said thermosensitive recording layer in which layer a spherical filler and irregular shape filler is employed.

10 Claims, No Drawings

THERMOSENSITIVE RECORDING MATERIAL

BACKGROUND OF THE INVENTION

1. Field of the Invention

The present invention relates to a thermosensitive recording material employing color formation by the chemical reaction between an electron donor compound and electron acceptor compound and more particularly to an improved thermosensitive recording material having excellent matching property on a thermal head.

2. Discussion of the Background

There are conventionally proposed various materials which utilize the coloring reaction between a colorless or light-colored leuco dye and a color developer capable of inducing color formation in the leuco dye upon application of heat or pressure thereto when brought into contact with the leuco dye.

A thermosensitive recording material of this type is useable as a recording material for a computer, facsimile apparatus, ticket vending apparatus, label printer, and recorder because it has the advantages that complicated processes such as development and image fixing are not required, recording can be performed, using a relatively simple apparatus, no noise is generated during the development, and the manufacturing cost is low.

In such a thermosensitive recording material, colorless or light-colored leuco dyes having a lactone, lactam, or spiropyran ring are used as coloring dyes, and organic acids or phenolic materials are conventionally employed as color developers. The thermosensitive recording material using the above-mentioned leuco dye and color developer is widely used because the produced images have a high density and the whiteness of the background is high.

These thermosensitive recording materials are generally manufactured by coating the coloring dyes and the coloring developers on a base, such as plain paper.

In recent years, in response to an increasing demand for producing high quality images, in many cases, the surface smoothness of the color developing layer is increased by the provision of an undercoat layer under the color developing layer.

Furthermore, in accordance with the diversification of the application of the thermosensitive recording material, a plastic film having high surface smoothness is used instead of plain paper as a base sheet.

Especially at the case of OHP, for purpose of producing the thermosensitive recording material having a transparent property, and a high quality image, a base sheet such as plastic film having a high surface smoothness is used, and an equally smooth coating layer is formed on the base sheet. But, a structure of the thermosensitive recording materials is not substantially different from those used with plain paper as a base sheet.

These thermosensitive recording materials can be brought into contact with the thermal head so closely that the thermosensitive recording materials exhibit excellent uniformity in coloring.

However, excellent contact between the thermosensitive recording material and the thermal head causes a sticking problem.

In order to prevent such sticking problem and also to improve head matching property, materials such as inorganic pigments are added to the thermosensitive recording materials.

However, such materials added to the recording material cause defacement of the thermal head.

The plastic film employed as the base sheet is highly electrostatically charged so that dust or less are caught on the surface of the thermosensitive recording material. Such dust, or less, is released from the molten coated layer of the recording material at printing.

The dust, or lees, is caught between the thermosensitive recording material and thermal head. This causes a problem in which a part of the developed image is developed with stripes. The stripe is called a white strip at this portion.

In conventional technology, a proposal has been made that an irregular shape filler is employed in a protective layer of the thermosensitive recording material in order to improve the sticking phenomenon, as disclosed in Japanese Laid-Open Patent Application 61-225096. Moreover, a thermosensitive recording material which has a protective layer employing a spherical filler is proposed. However, effect of preventing the white stripes is not completely successful because the surface of the protective layer cannot be enough roughed only by the spherical filler.

On the other hand, using only an irregular shaped filler, the problem of thermal head defacement cannot be solved.

In other words, as long as one of the spherical filler or the irregular filler is used, the problem of thermal head defacement and the white stripe and sicking problem cannot be solved at the same time.

SUMMARY OF THE INVENTION

Accordingly, an object of the invention is to provide a thermosensitive recording material that does not include an ingredient in the coating layer which is molten upon developing and adhered to thermal head. Another object of this invention is to provide a thermosensitive recording material not yielding a white stripe, and a thermosensitive recording material being decreased a head defacement. The phenomenon is below described as stick or sticking.

DESCRIPTION OF THE PREFERRED EMBODIMENT

The thermosensitive recording material according to the invention comprises a thermosensitive recording layer comprising a binder resin, and a leuco dye and a color developer capable of inducing color formation in the leuco dye upon application of heat thereto, and a protective layer on the thermosensitive recording layer in which layer a spherical filler and an irregular shape filler is employed. Moreover, in the thermosensitive recording material, the particle diameter of the spherical filler employed in the protective layer is from 0.1 $\mu$m to 2.0 $\mu$m, and the particle diameter of the irregular shaped filler employed in the protective layer is from 0.1 $\mu$m to 1.0 $\mu$m. Further, the volume average particle diameter of the spherical filler is larger than the volume average particle diameter of the irregular shaped filler. Further, in the thermosensitive recording material, the ratio of spherical filler and irregular shaped filler which are employed in the protective layer is from 1 part to 3 parts irregular filler per 1 part of a spherical filler. Preferably, in the thermosensitive recording material, the ratio of filler and binder which are employed in the protective layer is from 2 part to 4 parts filler per 1 part of binder.

For a preferred embodiment, in the protective layer, a cross-linked polystyrene resin is used as a spherical filler and a Kaolin particles are used as irregular shape filler, and a polyvinylacetal resin, which has a polymerization degree over 2000, is employed as the binder of the protective layer. An isocyanate compound is employed as cross-linking agent.

In the thermosensitive recording material according to the present invention, the amount of the thermal defacement is reduced because of the decreasing content of irregular shaped filler.

As a result of our studying for improvement of white stripe phenomenon, it has been determined that said phenomenon is influenced by surface roughness and the coefficient of friction. In addition, we discovered that using both a spherical filler and an irregular shaped filler in the protective layer has the effect of suitably adjusting the surface roughness and the coefficient of friction to suppress white stripe phenomenon. More specifically, the spherical filler has a close-packing effect which brings about a heat resistant effect on the protective layer. The irregular shaped filler has the effect of appropriately roughening the surface of the protective layer.

The term "irregular shaped filler" used herein means a filler having corners, other than the above-mentioned spherical filler, which may be in the shapes such as needle shape, thin leaf shape, polyhedron shape, grain shape, or the like.

For example, specific examples of the filler are as below:

phosphate fibers, potassium titanate, needle shaped magnesium, wisker, talk, mica, flass flake, calcium carbonate, plate shaped calcium carbonate, aluminum hydroxide, plate shaped aluminum hydroxide, silica, clay, Kaolin, etc.

To prevent sticking phenomenon, (1) a wax may be used in the protective layer, or (2) a resin modified by silicone alone, or with other resins, is used as a binder resin in the layer, (3) adjusting the mixing ratio between the resin and a filler, (4) changing the mixing ratio of a spherical filler and an irregular shaped filler, or a combination of these approaches may be used to adjust the dynamic friction coefficient.

Specific examples of kinds of wax used according to the present invention are:

stearic acid amide, palmitic acid amide, oleic acid amide, lauric acid amid, ethylene-bis-stearic acid amide, methylene-bis-stearic acid amide, methylol stearic acid amide, paraffin wax, polyethylene, carnauba wax, oxidized paraffin, zinc stearate, and the like.

Irregular shaped fillers according to the present invention may be of, silica, clay, talc, calcium carbonate, calcined clay, aluminum hydroxide, hydro-talcite, and general inorganic pigments, said pigments exhibiting a surface treated by a saline coupling agent.

Specific examples of spherical filler for use in the present invention are organic fillers such as cross-linked-polystyrene resin, urea-formaldehyde resin, silicon resin, cross-linked polymethacrylate-methyl-acrylate resin, melamine-formaldehyde resin, and the like.

Furthermore, inorganic fillers whose surface is treated with wax or the like so as to take on a spherical shape can also be employed as spherical filler.

The preferable ratio of the binder to the filler per the protective layer is from 1:0.5 to 1:6, more preferably from 1:2 to 1:4. In the case of a layer containing a ratio of binder to filler below 1:0.5, the reduction of the white stripe effect is reduced, while in the case of a layer with a ratio of binder to filler over 1:6, the effect of resin as binder is reduced and peeling off of the protective layer readily occurs.

For the spherical filler, the preferable volume average particle diameter of filler employed with the resin is from 0.1 to 2.0 $\mu$m, from the view point of smoothing and compacting the protective layer while keeping dote uniformity. For the irregular shape filler, the preferable volume average particle diameter of filler employed with the resin is from 0.1 to 1.0 $\mu$m, from the viewpoint of providing a finely roughened surface of the protective layer, and at the same time, of keeping dot uniformity. It is preferable that the spherical filler particle diameter be greater than that of the irregular shape filler, to provide a finely roughened protective layer surface.

The coefficient of dynamic friction of the surface of the protective layer, the surface roughness of the protective layer, and the transparency of the recording material can be adjusted by selecting the kinds of the above-mentioned resin and filler, the amounts thereof, the ratio, and the particle diameters of the fillers.

The preferable ratio of the irregular shape filler to the spherical filler is from 1:0.5 to 1:5, more preferably from 1:1 to 1:3, in consideration of the goals of dense packing of the spherical filler, and the modification of surface roughness by the irregular shape filler. Where the ratio of the irregular shape filler to the spherical filler is less than 0.5, there is little reduction of the white stripe effect, and where the ratio of the irregular shape filler to the spherical filler to is more than 1:5, the possibility of developing head defacement increases.

To control head defacement, white stripe, and dot uniformity, as well as sticking in the present invention, it is preferable that particles having a volume average particle diameter of from 0.6 to 0.8 $\mu$m be employed as the spherical filler, especially cross-linked-polystyrene resin particles. As the irregular shaped filler, it is preferable that a powder which has a volume average particle diameter of from 0.3 to 0.5 $\mu$m be employed, especially kaolin powder.

The substrate for use as in the present invention is not particularly limited, but may be selected from the following:

polyester film such as polyethylene-terephthalate and polybutylene-terephthalate, cellulose film such as triacetate cellulose, polyolefin film such as polyethylene and polypropylene, polystyrene film, paper, and synthetic paper. These films are used individually or in a combination in which a plurality of films are laminated each other.

As a coloring agent for use in the present invention, which is an electron donor compound and may be employed individually or in combination, any known colorless or pale-colored dye precursor presently used in conventional thermosensitive recording materials can be employed. For example, such leuco compounds as triphenylmethanephtalide, trialllylmethane, fluoran, phenothazine, thiofluoran, xanthene, indophtayl, spiropyran, azaphthalide, chromenopyrazole, methine, rodamineanilinolactam, rhodaminelactam, quinazoline, diazaxanthene, and bislactone are preferably employed/

Specific examples of suitable leuco dyes include, but are not limited to:

2-anilino-3-methyl-6-diethylaminofluoran, 2-anilino-3-methyl-6-(di-n-butylamino)fluoran, 2-anilino-3-methyl-6-(N-n-propyl-N-methylamino) fluoran, 2-anilino-3-methyl-6-(N-isopropyl-N-methylamino) fluoran, 2-anilino-3-methyl-6-(N-isobutyl-N-methylamino) fluoran, 2-anilino-3-methyl-6-(N-n-amyl-N-methylamino) fluoran, 2-anilino-3-methyl-6-(N-sec-butyl-N-ethylamino) fluoran, 2-anilino-3-methyl-6-(N-n-amyl-N-ethylamino)fluoran,
2-anilino-3-methyl-6-(N-n-isoamyl-N-ethylamino) fluoran,
2-anilino-3-methyl-6-(N-n-propyl-n-isopropylamino) fluoran,
2-anilino-3-methyl-6-(N-cyclohexyl-N-methylamino) fluoran,
2-anilino-3-methyl-6-(N-ethyl-p-toluldino)fluoran,
2-anilino-3-methyl-6-(N-methyl-p-toluldino)fluoran,
2-(m-trichloromethylanilino)-3-methyl-6-diethylamino-fluoran,
2-(m-trifluoromethylanilino)-3-methyl-6-diethylamino-fluoran,
2-(m-trilluoromethylanilino)-3-methyl-6-(N-cyclohexyl-N-methylamino)fluoran,
2-(2,4-dimethylanilino)-3-methyl-6-diethylamino-fluoran,
2-(N-ethyl-p-toludino)-3-methyl-6-(N-ethylanilino)-fluoran,
2-(N-ethyl-p-toludino)-3-methyl-6-(N-propyl-p-toluldino)-fluoran,
2-anilino-6-(N-n-hexyl-N-ethylamino)fluoran,
2-(o-chloroanilino)-6-diethylaminofluoran,
2-(o-bromoanilino)-6-diethylaminofluoran,
2-(o-chloroanilino)-6-dibutylaminofluoran,
2-(o-fluoroanilino)-6-dibutylaminofluoran,
2-(m-trifluoromethylanilino)-6-diethylaminofluoran,
2-(p-acetylanilino)-6-(N-n-amyl-N-butylamino)fluoran,
2-benzylamino-6-(N-ethyl-6-toluldino)fluoran,
2-benzylamino-6-(N-methyl-2,4-dimethylanolino) fluoran,
2-benzylamino-6-(N-ethyl-2,4-dimethylanolino)fluoran,
2-benzylamino-6-(N-methyl-p-toluidino)fluoran,
2-benzylamino-6-(N-ethyl-p-toluidino)fluoran,
2-(di-p-methylbenzylamino)-6-(N-ethyl-p-toludino) fluoran,
2-(α-phenylethylamino)-6-(N-ethyl-p-toluldino)fluoran,
2-metylamino-6-(N-methylanilino)fluoran,
2-metylamino-6-(N-ethylanilino)fluoran,
2-metylamino-6-(N-propylanilino)fluoran,
2-ethylamino-6-(N-methyl-p-toluidino)fluoran,
2-metylamino-6-(N-methyl-2,4-dimethylanilino)fluoran,
2-etylamino-G-(N-methyl-2,4-dimethylanilino)fluoran,
2-dimetylamino-6-(N-methylanilino)fluoran,
2-dimetylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran, 3-bromo-6-cyclohexylaminofluoran, 2-chloro-6-(N-ethyl-N-isoamylamino)fluoran, 2-chloro-3-methyl-6-diethylaminofluoran,
2-anilino-3-chloro-6-cyclohexylaminofluoran,
2-(2,3-tryfluoromethylanilino)-3-chloro-6-dietylaminofluoran,
1,2-(2,3-dichloro anilino)-3-chloro-6-diethylaminofluoran,
1,2-benzo-6-diethylaminofluorn,
1,2-benzo-6-(N-ethyl-N-isoamylamino)fluoran,
1,2-benzo-6-dibuthylaminofluoran,
1,2-benzo-6-(N-ethyl-N-cyclohexylamino)fluoran,
1,2-benzo-6-(N-ethyl-p-toluidino)fluoran, As a color developer for use in the present invention, which is an electron acceptor compound, any conventional color developer may be employed. Preferable color developers for use in the present invention are electron acceptors having a long chain alkyl group in their molecular structure which are disclosed in, for example, Japanese Laid-Open Patent Application 03-355078. For example, organic phosphoric acid compounds, aliphatic carboxylic acid compounds, phenolic compounds, each including an aliphatic group having more than 12 carbon atoms, metal salts of mercaptoacetic acid including an aliphatic group having from 10 to 18 carbon atoms, alkyl esters of caffeic acid including an alkyl group having from 5 to 8 carbon atoms, and acidic esters of phosphoric acid including an aliphatic group having more than 16 carbon atoms are preferably employed. The above mentioned aliphatic group includes a linear alkyl group, a branched alkyl group, a linear alkenyl group and a branched alkenyl group, and may have substituents of, for example, a halogen, an alkoxy group and an ester. Specific examples of those color developers are as follows but are not limited to:

(a) organic phosphoric acid compounds

A preferable organic phosphoric acid compound is represented by the following formula (1)

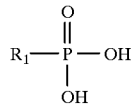

(1)

wherein $R_1$ represents a linear alkyl group having from 12 to 28 carbon atoms.

Specific examples of the compound represented by formula (1) are as follows:

dodecylphosphonate,
tetradecylphosphonate,
hexadecylphosphonate, octadecylphosphonate, eicosylphosphonate, docosylphosphonate, tetracosylphosphonate, hexacosylphosphonate, and octacosylphosphonate.

Another preferable organic phosphoric acid compound is an α-hydroxylphosphonate compound represented by the following formula (2):

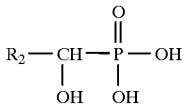

(2)

wherein $R_1$ represents a linear alkyl group having from 11 to 29 carbon atoms.

Specific examples of the compound represented by formula (2) are as follows:

α-hydroxydodecylphophonate,

α-hydroxytetradecylphosphonate,

α-hydroxyhexadecylphosphonate,

α-hydroxyoctadecylphosphonate,

α-hydroxyeicosylphosphonate,

α-hydroxydocosylphosphonate, and

α-hydroxytetracosylphosphonate.

Yet another preferable organic phosphoric compound is an acidic phosphoric acid ester compound represented by the following formula (3):

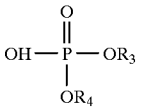

(3)

wherein $R_3$ represents a aliphatic group having more than 16 carbon atoms, and $R_4$ represents hydrogen or an aliphatic group having more than 1 carbon atom.

Specific examples of the compound represented by formula (3) are as follows:

dihexadecylphosphates, dioctadecylphosphates, dieicosylphosphates, didocosylphosphates, monohexadecylphosphates, monooctadecylphosphates, monoeicosylphosphates, monodocosylphosphates, methylhexadecylphosphates, methyloctadecylphosphates, methyldocosylphosphates, amylhexadecylphosphate, octylhexadecylphosphate, and laurylhaxadecylphosphate.

(B) aliphatic carboxylic acid compounds

A preferable aliphatic carboxylic acid compound is an α-hydroxy aliphatic acid compound represented by the following formula (4):

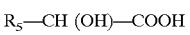

$R_5$—CH (OH)—COOH (4)

wherein $R_5$ represents an aliphatic group having more than 12 carbon atoms.

Specific examples of the compound are as follows:

α-hydroxy decanoic acid,

α-hydroxy tetradecanoic acid,

α-hydroxy hexadecanoic acid,

α-hydroxy octadecenoic acid,

α-hydroxy pentadecanoic acid,

α-hydroxy eicosanoic acid,

α-hydroxy docosanoic acid,

α-hydroxy tetracosanoic acid,

α-hydroxy hexacosanoic acid, and

α-hydroxy octacosanoic acid,

Another preferable aliphatic carboxylic acid compound is aliphatic carboxylic acid including an aliphatic group having more than 12 carbon atoms, and a halogen in at least its α or β position carbon atom.

Specific examples of the compound are as follows:

2-bromohexadecanoic acid, 2-bromoheptadecanoic acid, 2-bromooctadecanoic acid, 2-bromoeicosanoic acid, 2-bromodocosanoic acid, 3-bromooctadecanoic acid, 3-bromoeicosanoic acid, 2,3-dibromooctadecanoic acid, 2-fluorododecanoic acid, 2-fluorotetradecanoic acid, 2-fluorohaxadecanoic acid, 2-fluorooctadecanoic acid, 2-fluoroeicosanoic acid, 2-fluorodocosanoic acid, 2-iodohaxadecanoic acid, 2-iodooctadecanoic acid, 3-iodohexadecanoic acid, 3-iodooctadecanoic acid, perfluorooctadecanoic acid.

Yet another preferable aliphatic carboxylic compound is an aliphatic carboxylic acid compound including an aliphatic group having more than 12 carbon atoms, and an oxo group in at least one of its α or γ position carbon atom.

Specific examples of the compound are as follows:

2-oxododecanoic acid, 2-oxotetradecanoic acid, 2-oxohexadecanoic acid, 2-oxooctadecanoic acid, 2-oxodeicosanoic acid, 2-oxotetracosanoic acid, 3-oxododecanoic acid, 3-oxotetradecanoic acid, 3-oxohexadecanoic acid, 3-oxooctadecanoic acid, 3-oxoeicosanoic acid, 3-oxotetracosanoic acid, 4-oxohexadecanoic acid, 4-oxooctadecanoic acid, and 4-oxodocosanoic acid.

Further examples of preferable aliphatic carboxylic acids include dibasic carboxylic acid compounds represented by the following formula (5):

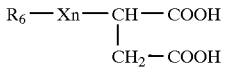

(5)

wherein $R_6$ represents an aliphatic group having more than 12 carbons atoms, and X represents an oxygen atom or a sulfur atom and n is 1 or 2.

Specific examples of the compound are as follows:

dodecylmalic acid,
tetradecylmalic acid,
hexadecylmalic acid,
octadecylmalic acid,
eicosylmalic acid,
docosylmalic acid,
tetracosylmalic acid,
dodecylthiomalic acid,
tetradecylthiomalic acid,
hexadecylthiomalic acid,
octadecylthiomalic acid,
eicosylthiomalic acid,
docosylthiomalic acid,
tetracosylthlomalic acid,
dodecyldithiomalic acid,
tetradecyldithiomalic acid,
eicosyldithiomalic acid,
docosyldithiomalic acid, and
tetracosyldithiomalic acid.

A still further example of preferable aliphatic carboxylic acid compounds are dibasic carboxylic acid compounds represented by the following formula (6):

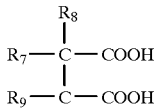

(6)

wherein $R_7$, $R_8$, and $R_9$ independently represent a hydrogen atom or an aliphatic group, and at least one of them is an aliphatic group having more than 12 carbon atoms.

Specific examples of the compound are as follows:

dodecylbutanedioic acid,
tridecylbutanedioic acid,
tetradecylbutanedioic acid,
pentadecylbutanedioic acid,
octadecylbutanedloic acid,
eicosylbutanedloic acid,
docosylbutanedioic acid,
2,3-dihexadecylbutanedioic acid,
2,3-dioctadecylbutanedioic acid,
2-methyl-3-dodecylbutanedioic acid,
2-methyl-3-tetradecylbutanedioic acid,
2-methyl-3-hexadecylbutanedioic acid,
2-ethyl-3-dodecylbutanedioic acid,
2-propyl-3-dodecylbutanedioic acid,
2-octyl-3-hexadecylbutanedioia acid,
2-tetradecyl-3-octadecylbutanedicic acid, Still further examples of preferable aliphatic carboxylic acid compound include dibasic carboxyl acids represented by the following formula (7):

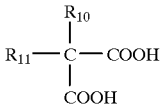

(7)

wherein $R_{10}$ and $R_{11}$ independently represent hydrogen atom or aliphatic group, and at least one of them is an aliphatic group having more than 12 carbon atoms.

Specific examples of the compound are as following:

dodecylmalonic acid,
tetradecylmalonic acid,
hexadecylmalonic acid,
octadecylmalonic acid,
eicosylmalonic acid,
docosylmalonic acid,
tetracisylmalonic acid,
ditetadecylmalonic acid,
didodecylmalonic acid,
ditetradecylmalonic acid,
dihexadecylmalonic acid,
dioctadecylmalonic acid,
dieicosylmalonic acid,
didocosylmalonic acid,
methyloctadecylmalonic acid,
methyldocosylmalonic acid,
methyltetracosylmalonic acid,
ethyloctadecylmalonic acid,
ethyleicosylmalonic acid,
ethyldocosylmalonic acid, and
ethyltetracosylmalonic acid.

Another example of preferable aliphatic carboxylic acid compounds is dibasic carboxylic acids represented by the following formula (8)

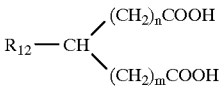

(8)

wherein $R_{12}$ represents hydrogen atom or an aliphatic group, and n is 0 or 1 and m is 1,2 or 3, and m is 2 or 3 in case n is 0, and m is 1 or 2 in case n is 1.

Specific examples of the compounds are as follows:

2-dodecyl-pentanedioic acid,
2-hexadecyl-pentanedioic acid,
2-octadecyl-pentanedioic acid,
2-eicosyl-pentanedioic acid,
2-docoyl-pentanedioic acid,
2-dodecyl-hexanedioic acid,
2-pentadecyl-hexanedioic acid,
2-octadecyl-hexanedioic acid,
2-eicosyl-hexanedioic acid, and
2-docosyl-hexanedloic acid.

Tribasic acid compounds which are acrylated by a long chain aliphatic acid may also be used as preferred carboxylic acid compounds.

Specific examples of the compound are as follows:

o-palmitylcitric acid

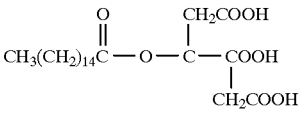

o-stearylcitric acid

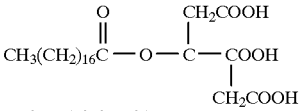

o-eicosylcitric acid

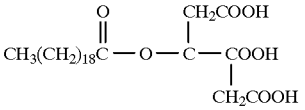

(C) phenolic compound

A preferable phenolic compound is a phenolic compound represented by following formula (9):

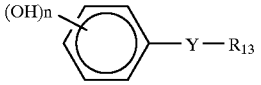

(9)

wherein Y represents —S—,—O—, —CONH— or —COO—, and $R_{13}$ represents an aliphatic group having more than 12 carbon atoms and n is 1, 2 or 3.

Specific examples of the compound are as follows:

p-(dodecylthio)phenol,
p-(tetradecylthio)phenol,
p-(hexadecylthio)phenol,
p-(octadecylthio)phenol,
p-(eicosylthio)phenol,
p-(docosylthio)phenol,
p-(tetracosylthio)phenol,
p-(dodecyloxy)phenol,
p-(tetradecyloxy)phenol,
p-(hexadecyloxy)phenol,
p-(octadecyloxy)phenol,
p-(eicosyloxy)phenol,
p-(docosyloxy)phenol,
p-(tetracosyloxy)phenol,
p-dodecylcarbamoylphenol,
p-tetradecylcarbamoylphenol,
p-hexadecylcarbamoylphenol,
p-octadecylcarbamoylphenol,
p-eicosylcarbamoylphenol,
p-docosylcarbamoylphenol,
p-tetracosylcarbamoylphenol,
hexadecyl gallate,
octadecyl gallate,
eicosyl gallate,
docosyl gallate, and
tetracosyl gallate.

Another preferable phenolic compound is a caffeic acid alkyl ester represented by the following formula (10):

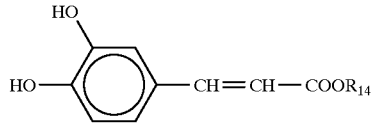

(10)

wherein $R_{14}$ represents an alkyl group having from 5 to 8 carbon atoms.

Specific examples of the compound are as follows:caffeic acid n-pentyl ester, caffeic acid n-hexyl ester, and caffeic acid n-octyl ester.

(D) metal salt of mercaptoacetic acid

A preferable metal salt of mercaptoacetic acid is a metal salt of alkyl- or alkenyl-mercaptoacetic acid represented by the following formula (11).

$$(R_{15}—S—CH_2—COO)_2M \quad (11)$$

wherein $R_{15}$ represents an aliphatic group having from 10 to 18 carbon atoms, and M represents Sn, Mg, Zn or Cu.

Specific examples of the compound are as follows:

Sn salt of decylmercaptoacetic acid,
Sn salt of dodecylmercaptoacetic acid,
Sn salt of tetradecylmercaptoacetic acid,
Sn salt of hexadecylmercaptoacetic acid,
Sn salt of octadecylmercaptoacetic acid,
Mg salt of decylmercaptoacetic acid,
Mg salt of dodecylmercaptoacetic acid,
Mg salt of tetradecylmercaptoacetic acid,
Mg salt of hexadecylmercaptoacetic acid,
Mg salt of octadecylmercaptoacetic acid,
Zn salt of decylmercaptoacetic acid,
Zn salt of dodecylmercaptoacetic acid,
Zn salt of tetradecylmercaptoacetic acid,
Zn salt of hexadecylmercaptoacetic acid,
Zn salt of octadecylmercaptoacetic acid,
Cu salt of decylmercaptoacetic acid,
Cu salt of dodecylmercaptoacetic acid,
Cu salt of tetradecylmercaptoacetic acid,
Cu salt of hexadecylmercaptoacetic acid, and
Cu salt of octadecylmercaptoacetic acid, The preferable content of the color developer is from about 1 to 20 parts by weight, more preferably from about 2 to 10 parts by weight, per 1 part by weight of the coloring agent. The color developers are employed alone or in combination.

As the binder agent for use in the thermosensitive recording layer of the present invention, any conventional binder agents used in the conventional thermosensitive recording materials can appropriately be employed. Examples of the binder agent include polyacryl amide, maleic acid copolymer, polyacrylate, polymethacrylate, copolymer of vinyl chloride and vinyl acetate, styrene copolymer, polyester, polyurethane, polyvinyl butyryl, ethylcellulose, polyvinyl acetal, polyvinyl acetoacetyl, polycarbonate, epoxy resin, and polyamide.

Thus, the main agents in the thermosensitive coloring layer of the present invention include, the leuco dyes, the color developers and binder resins as previously described.

However, when necessary, in the present invention, a conventional filler, a pigment, a surface active agent, a thermofusible material can be employed in the thermosensitive coloring layer.

The resin used in the protective layer of the present invention is mainly soluble in an organic solvent, accordingly, when a solution of the resin is coated on the thermosensitive coloring layer, as a result, leuco dyes and the color developer are combined, and the thermosensitive coloring layer may be developed. To prevent the developing, the following methods are preferably used, (1) A leuco dyes and/or a color developer, which are not soluble or only slightly soluble in the solvent, are selected.

(2) The leuco dyes and/or a color developer are contained within microcapsules. As a result, contact between the leuco dyes and the coloring developer are arrested.

(3) A resinous layer is overlaid on the thermosensitive layer, as a result, contact of between the leuco dyes and a coloring developer due to solvent from the protective layer is suppressed.

In the above-mentioned methods, it is preferable that the organic phosphoric compound represented by the formula(l) as a coloring developer be used from the viewpoint of head-matching, developing density, developing sensitivity, and developing by a solvent.

The formation of the thermosensitive coloring layer the present invention can be achieved by steps including preparing a coating liquid, coating the liquid on the substrate by means of conventional coating method, and drying the coated liquid. No particular coating method is employed in the present invention.

When the coating liquid for the formation of the thermosensitive coloring layer is a dispersion of a color developing agent, the particle diameter of the color developing agent has a significant effect on the roughness of the protective layer and accordingly on the dot uniformity at printing, so that it is preferable that the particle diameter of the color developing agent be 0.5 μm or less.

The dry thickness of the thermosensitive coloring layer, which depends on the formation of the coating liquid or application of the thermosensitive recording material, is preferably from about 1 to 50 μm, more preferably from about 3 to 20 μm.

To improve surface smoothness, the thermosensitive recording layer may further be formed over an intermediate layer including a filler, a binder and a thermofusible material between the substrate and the thermosensitive coloring layer.

The thermosensitive recording material may further include a protective layer which is formed on the thermosensitive coloring layer in order to improve the resistance to light, chemicals, water and rubbing. Specific examples of resin employed in said protective layer are as follows:

polyacrylate, polymethacrylate, polyvinyl butyryl, polyvinyl acetoacetyl, ethylcellulose, methylcellulose, celluloseacetate, hydroxyethyl cellulose, celluloseacetate propionate, polyurethane resin, polyester resin, polyvinyl acetate, styrene acrylate, polyolefin resin, polystyrene, polyvinyl chloride, polyether resins, polyamide resins, polycarbonate, polyethylene, polypropylene and polyacrylamide.

Further, to adjust the coefficient of friction, a modified silicon resin is employed alone or with said resin. A modified silicon resin is a resin which has a alkyl group such as a methyl group, which is bound to the silicon atom, and additionally has a siloxane bond.

Said modified silicon resin may be copolymerized with a resin having organpolysiloxane which has a reactive group such a hydroxy group, a carboxyl group, a epoxy group, a amino group, a mercapto group, etc. Additionally, when necessary, a cross-linking agent is employed.

As a cross-linking agent used with a resin, conventional cross-linking agent can be employed.

A combination of a resin of polyvinyl acetal having polymerization degree more than 2000 and an isocyanate compound is preferable for use in this invention. Specific examples of isocyanate compounds are as follows:

toluenediisocyanate dimer, isocyanate polymethylene-polyphynel isocyanate, hexamethylene diisocyanate, etc.

The coating methods for the protective layer of the present invention are a conventional coating method and are not intended to be limiting.

The preferable dry thickness of the protective layer is from 0.1 to 20 μm, more preferably from 0.5 to 10 μm. When the thickness of the protective layer is too thin, the protective layer fails in preservation of recording material, or head matching, which is the protective layer function. When the thickness of the protective layer is too thick, the thermal sensitivity of the recording material goes down, and/or the material becomes more costly at no advantage.

As a printing method to print image on the thermosensitive recording material of the present invention, any conventional printing method using, e.g, thermal pen, a thermal print head and laser beams, may be used. The invention is not limited to a specific printing method.

Other features of this invention will become apparent in the course of the following description of exemplary embodiments, which are given for illustration of the invention and are not intended to be limiting thereof. For further, both the part and % are in weight ratio in the following description.

EXAMPLE 1

A mixture of the following pulverized and dispersed in a ball mill in order that the average particle diameter of the following composite was adjusted to be 0.3 μm, so that a coating liquid of a recording layer was prepared.

[Liquid A]

| | parts by weight |
|---|---|
| 2- -anilino-3-methyl-6-diethylaminofluoran | 4 |
| octadecyl phosphonate | 12 |
| polyvinyl butyryl (Denka Butyryl #3000-2, manufactured by Denki Kagaku Kogyo Co., Ltd) | 6 |
| toluene | 57 |
| methyl ethyl ketone | 57 |

The liquid A was coated on a substrate of polyester film of 75 μm thick, and dried to form a thermosensitive coloring layer of 10 μm dry thickness.

A mixture of the following pulverized and dispersed in a ball mill in order that the volume average particle diameter of the following composite became to be 0.3 μm, so that a coating liquid B of protective layer was prepared.

[Liquid B]

| | parts by weight |
|---|---|
| kaolin powder (ASP-170 manufactured by Engel-Hard Co., Ltd) | 30 |
| 10% polyvinyl acetoacetyl methyl ethyl acetone solution (polyvinyl acetoacetyl KS-1 manufactured by Sekisui Chemical Co., Ltd) | 30 |
| methyl ethyl ketone | 140 |

A mixture of the following was dispersed in a ball mill, so that a coating liquid C of protective layer was prepared.

[Liquid C]

| | parts by weight |
|---|---|
| crosslinked polystyrene (PP-600 manufactured by Mithui Toathu Co., Ltd, particle diameter is 0.6 μm) | 30 |
| 10% polyvinyl acetoacetyl methyl ethyl ketone solution (polyvinyl acetoacetyl KS-1 manufactured by Sekisui Chemical Co., Ltd) | 30 |
| methyl ethyl ketone | 140 |

A mixture of the following preparation was fully stirred up, so that a coating liquid of protective layer was prepared.

[Liquid D]

| | parts by weight |
|---|---|
| Liquid B | 100 |
| Liquid C | 50 |
| silicone-modified polyvinyl butyryl (SP-712, manufactured by Dainichiselka Color & Chemical Mfg. Co., Ltd, parts of solid component is 12.5%.) | 12 |
| 5% polyvinyl acetoacetyl methyl ethyl ketone solution (polyvinyl acetoacetyl KS-5 manufactured by Sekisui Chemical Co., Ltd, polymerization degree is 2400.) | 102 |
| methylene-di-isocyanate derivative (Colonate HX, manufactured by Japan Polyuretan Co., Ltd,) | 1 |
| methyl ethyl ketone | 41 |
| toluene | 69 |

The coating liquid of the protective layer was coated on the above-prepared thermosensitive coloring layer, and dried to form a protective layer of 3 μm. Thus, a thermosensitive recording material of the present invention was obtained.

EXAMPLE 2

A formation of the thermosensitive coloring layer in Example 1 was repeated by above coating liquid, the thermosensitive coloring layer was formed on a substrate of polyester film. A mixture of the following was fully stirred up, so that a coating liquid E of protective layer is prepared.

[Liquid E]

| | parts by weight |
|---|---|
| Liquid B | 100 |
| Liquid C | 100 |
| silicone-modified polyvinyl butyryl (SP-712, manufactured by Dainichiselka Color & Chemical Mfg. Co., Ltd, parts of solid component is 12.5%.) | 12 |
| 10% polyvinyl acetoacetyl methyl ethyl ketone solution (polyvinyl acetoacetyl KS-1 manufactured by Sekisui Chemical Co., Ltd, polymerization degree is 500.) | 102 |
| methyl ethyl ketone | 110 |
| toluene | 86 |

The coating liquid of the protective layer was coated on the above-prepared thermosensitive coloring layer, and dried to form a protective layer of 3 μm. Thus, a thermosensitive recording material of the present invention was obtained.

EXAMPLE 3

A formation of the thermosensitive coloring layer in Example 1 was repeated by above coating liquid, the thermosensitive coloring layer was formed on a substrate of polyester film. A mixture of the following was dispersed in a ball mill, so that a coating liquid F of protective layer was prepared.

[Liquid F]

| | parts by weight |
|---|---|
| melamine-formaldehyde resin (Epostar-S manufactured by Nippon Catalyzer Co., Ltd, particle diameter is 0.3 μm) | 30 |
| 10% polyvinyl acetoacetyl methyl ethyl ketone solution (polyvinyl acetoacetyl KS-1 manufactured by Sekisui Chemical Co., Ltd,) | 30 |
| methyl ethyl ketone | 140 |

A mixture of the following was fully stirred up, so that a coating liquid G of protective layer is prepared.

[Liquid G]

| | parts by weight |
|---|---|
| Liquid B | 100 |
| Liquid F | 50 |
| silicone-modified polyvinyl butyryl (SP-712, manufactured by Dainichiselka Color & Chemical Mfg. Co., Ltd, parts of solid component is 12.5%.) | 12 |
| 5% polyvinyl acetoacetyl methyl ethyl ketone solution (polyvinyl acetoacetyl KS-5 manufactured by Sekisui Chemical Co., Ltd, polymerization degree is 2400.) | 120 |
| methyl ethyl ketone | 41 |
| toluene | 69 |

The coating liquid of the protective layer was coated on the above-prepared thermosensitive coloring layer, and dried to form a protective layer of 3 μm. Thus, a thermosensitive recording material of the present invention was obtained.

EXAMPLE 4

A formation of the thermosensitive coloring layer in Example 1 was repeated, the thermosensitive coloring layer was formed on a substrate of polyester film. A mixture of the following was pulverized and dispersed in a ball mill in order that the volume average particle diameter of the following composite became to be 0.3 μm, so that a coating liquid H of protective layer was prepared.

[Liquid H]

| | parts by weight |
|---|---|
| aluminum hydroxide powder (H43M manufactured by Showa Denko Co., Ltd) | 30 |
| 10% polyvinyl acetoacetyl methyl ethyl keytone solution | 30 |

-continued

| [Liquid H] | parts by weight |
|---|---|
| (polyvinyl acetoacetyl KS-1 manufactured by Sekisui Chemical Co., Ltd) | |
| methyl ethyl ketone | 140 |

A mixture of the following was dispersed in a ball mill, so that a coating liquid I of protective layer was prepared.

| [Liquid I] | parts by weight |
|---|---|
| silicone resin (Tospearl 102 manufactured by Toshiba Silicone Co., Ltd, a particle diameter is 2.0 m) | 30 |
| 10% polyvinyl acetoacetyl | |
| methyl ethyl ketone solution (polyvinyl acetoacetyl KS-1 manufactured by Sekisui Chemical Co., Ltd) | 30 |
| methyl ethyl ketone | 140 |

A mixture of the following was fully stirred up, so that a coating liquid J of protective layer was prepared.

| [Liquid J] | parts by weight |
|---|---|
| Liquid H | 50 |
| Liquid I | 50 |
| silicone-modified polyvinyl butyryl (SP-712, manufactured by Dainichiselka Color & Chemical Mfg. Co., Ltd, parts of solid component is 12.5%.) | 12 |
| 10% polyvinyl acetoacetyl | |
| methyl ethyl ketone solution (polyvinyl acetoacetyl KS-1 manufactured by Sekisui Chemical Co., Ltd, polymerization degree is 500.) | 60 |
| methyl ethyl ketone | 58 |
| toluene | 52 |

COMPARATIVE EXAMPLE 1

A formation of the thermosensitive coloring layer in Example 1 was repeated, the thermosensitive coloring layer was formed on a substrate of polyester film. A mixture of the following was dispersed in a ball mill, so that a coating liquid K of protective layer was prepared.

| [Liquid K] | parts by weight |
|---|---|
| silicone resin (Tospearl 105 manufactured by Toshiba Silicone Co., Ltd, a particle diameter is 0.5 μm) | 30 |
| 10% polyvinyl acetoacetyl | |
| methyl ethyl ketone solution (polyvinyl acetoacetyl KS-1 manufactured by Sekisui Chemical Co., Ltd) | 30 |
| methyl ethyl ketone | 140 |

A mixture of the following was fully stirred up, so that a coating liquid L of protective layer was prepared.

| [Liquid L] | parts by weight |
|---|---|
| Liquid K | 150 |
| silicone-modified polyvinyl butyryl (SP-712, manufactured by Dainichiselka Color & Chemical Mfg. Co., Ltd, parts of solid component is 12.5%.) | 12 |
| 10% polyvinyl acetoacetyl | |
| methyl ethyl ketone solution (polyvinyl acetoacetyl KS-1 manufactured by Sekisui Chemical Co., Ltd, polymerization degree is 500.) | 60 |
| methyl ethyl ketone | 84 |
| toluene | 69 |

The coating liquid of the protective layer was coated on the above-prepared thermosensitive coloring layer, and dried to form a protective layer of 3 μm. Thus, a thermosensitive recording material was obtained.

COMPARATIVE EXAMPLE 2

A formation of the thermosensitive coloring layer in Example 1 was repeated by above coating liquid, the thermosensitive coloring layer was formed on a substrate of polyester film. A mixture of the following was pulverized and dispersed in a ball mill in order that the volume average particle diameter of the following composite was adjusted to be 0.3 μm, so that a coating liquid M of protective layer is prepared.

| [Liquid M] | parts by weight |
|---|---|
| silica (P-832 manufactured by Mizusawa Industry Co., Ltd,) | 30 |
| 10% polyvinyl acetoacetyl | |
| methyl ethyl ketone solution (polyvinyl acetoacetyl KS-1 manufactured by Sekisui Chemical Co., Ltd) | 30 |
| methyl ethyl ketone | 140 |

A mixture of the following was fully stirred up, so that a coating liquid N of protective layer was prepared.

| [Liquid N] | parts by weight |
|---|---|
| Liquid M | 100 |
| silicone-modified polyvinyl butyryl (SP-712, manufactured by Dainichiselka Color & Chemical Mfg. Co., Ltd, parts of solid component is 12.5%.) | 12 |
| methyl ethyl ketone | 70 |
| toluene | 52 |

The coating liquid of the protective layer was coated on the above-prepared thermosensitive coloring layer, and dried to form a protective layer of 3 μm. Thus, a the:rmosensitive recording material was obtained.

The thermosensitive recording materials manufactured by above methods were evaluated with respect to the following items.

(1) White Strips

A solid-developed image was printed by a thermal printing simulator, manufactured by Ookura Electric Co., Ltd, under the following conditions on each thermosensitive recording material.

Printing conditions

Dots density of the thermal-head: 8 dots/mm

Applied electric power: 0.68 w/dot

Pulse width: 0.30 msec

Period for one line: 10 ms/line

Printing length: 30 cm

Printing width: 20 cm

The white strips in printing image were counted with the eye.

(2) Sticking

The printing accomplished under condition which are the same as conditions given above for the white strips evaluation, however the pulse width was adjusted to 0.50 msec. Under the printing press, the sticking sound between the thermosensitive recording material and the thermal head was evaluated with the following standard.

The standard

0 . . . there is little sound of the sticking

Δ . . . there is a little sound of the sticking x . . . there is significant sound of the sticking (3) Peeling of the Protective Layer A developed image was printed by a thermal printing simulator, manufactured by Ookura Electric Co., Ltd, under the following conditions on each thermosensitive recording material.

Printing conditions

Dots density of the thermal-head: 8 dots/mm

Applied electric power: 0.68 w/dot

Pulse width: 0.20~1.2 msec, 0.1 msea notch

Period for one line: 10 ms/line

Under said printing conditions, the pulse width at which the peeling of protective layer begins to peel was evaluated.

(4) Dot Uniformity

The printing was performed under the same conditions as the white stripe evaluation. Further, the surface of the printed portion was observed through an optical microscope, and the dot uniformity was evaluated with the eye.

The standard

0 . . . it showed good reproducibility of fine dot images. (the dot shape was reproduced, further, dots were uniformly colored.

Δ . . . it showed slightly impaired reproducibility of fine dot images. (the reproducibility of dot shape and the coloring uniformity was reduced.)

x . . . it showed bad reproducibility of fine dot images. (Neither dot shape nor color was reproduced uniformly)

(5) Head Defacement

A solid-developed image was printed by a thermal printing simulator, manufactured by Ookura Electric Co., Ltd, under the following conditions on each thermosensitive recording material.

Printing conditions

Dots density of the thermal-head: 8 dots/mm

Applied electric power: 0.68 w/dot

Pulse width: 0.30 msec

Period for one line: 10 ms/line

Printing length: 5 cm

Printing width: 3 cm

The printing repeatedly was performed under said conditions, the total printing length became to 1 km. Further, the head defacement was evaluated.

The results of said evaluation are shown below.

| | White strips | Sticking | The peeling | Head defacement | Dot uniformity |
|---|---|---|---|---|---|
| Example 1 | 0 line | 0 | nothing | 0.0 μm | 0 |
| Example 2 | 0 line | 0 | 0.9 msec | 0.0 μm | 0 |
| Example 3 | 1 line | 0 | 1.0 msec | 0.0 μm | 0 |
| Example 4 | 2 lines | 0 | 1.0 msec | 0.0 μm | Δ |
| Comparative Example 1 | 10 lines | 0 | 0.8 msec | 0.0 μm | 0 |
| Comparative Example 2 | 0 lines | Δ | 1.0 msec | 0.2 μm | X |

What is claimed as new and desired to be secured by Letters: Patent of the United States is:

1. A thermosensitive recording material comprising a thermosensitive recording layer comprising a binder resin, a leuco dye and a color developer capable of inducing color formation in said leuco dye upon application of heat thereto, and a protective layer on said thermosensitive recording layer, said protective layer comprising a spherical filler and an irregular shaped filler, wherein said spherical filler has a particle diameter of from 0.1 micron to 2.0 micron, said irregular shaped filler has a particle diameter of 0.1 micron to 1.0 micron, said irregular shaped filler is present in a ratio from one to three parts by weight per one part by weight of said spherical filler, and wherein said spherical filler has a larger volume average particle diameter than that of said irregular shaped filler.

2. The thermosensitive recording material as claimed in claim 1, wherein said fillers are present in a ration of from 2 to 4 parts by weight per 1 part by weight of said binder resin.

3. The thermosensitive recording material as claimed in claim 1, wherein said protective layer comprises, a crosslinked polystyrene resin as said spherical filler and Kaolin as said irregular shaped filler.

4. The thermosensitive recording material as claimed in claim 1 wherein said protective layer binder comprises a polyvinyl-acetal resin, which has a polymerization of degree over 2000, cross-linked with an isocyanate cross-linking compound.

5. A thermosensitive recording material, comprising:

(a) a substrate comprised of a plastic film selected from the group consisting of polyester film, cellulose film, polyolefin film, polystyrene film and synthetic paper, or a plurality of said films laminated together, (b) a thermosensitive recording layer formed on said substrate comprising a binder resin, a leuco dye and a color developer capable of inducing color formation in said leuco dye upon application of heat thereto, and (c) A protective layer on said thermosensitive recording layer comprising a spherical filler having a particle diameter of from 0.1 μM to 2.0 μM and an irregular shaped filler having a particle diameter from 0.1 μM to 1.0 μM.

6. The thermosensitive recording material as claimed in claim 5, wherein the volume average particle diameter of said spherical filler is larger than the volume average particle diameter of said irregular shape filler.

7. The thermosensitive recording material as claimed in claim 5, wherein said irregular shaped filler is present in a ratio of from 1 to 3 parts by weight per 1 part by weight of said spherical filler.

8. The thermosensitive recording material as claimed in claim 5, wherein said fillers are present in a ratio of from 2 to 4 parts by weight per 1 part by weight of said binder resin.

9. The thermosensitive recording material as claimed in claim 5, wherein said protective layer comprises, a cross-linked polystyrene resin as said spherical filler and Kaolin as said irregular shaped filler.

10. The thermosensitive recording material as claimed in claim 5, wherein said protective layer binder comprises a polyvinyl-acetyl resin, which has a polymerization of degree over 2000, cross-linked with an isocyanate cross-linking compound.

* * * * *